United States Patent [19]

DeMaagd

[11] 4,219,902

[45] Sep. 2, 1980

[54] VACUUM CLEANING

[75] Inventor: Donald R. DeMaagd, Grandville, Mich.

[73] Assignee: Oreck Corporation, New Orleans, La.

[21] Appl. No.: 10,599

[22] Filed: Feb. 9, 1979

[51] Int. Cl.[3] ..... A47L 9/04; A47L 9/06

[52] U.S. Cl. ..... 15/364; 15/42; 15/398; 15/420

[58] Field of Search ..... 15/42, 364, 416, 420, 15/398, 400, 367

[56] References Cited

U.S. PATENT DOCUMENTS

| | | | |
|---|---|---|---|
| 1,094,579 | 4/1914 | Matchette | 15/367 |
| 1,404,889 | 1/1922 | Owen | 15/420 |
| 1,560,400 | 11/1925 | Vander Putten | 15/420 |
| 1,782,882 | 11/1930 | Rippey | 15/416 X |
| 2,348,861 | 5/1944 | Smellie | 15/416 X |
| 4,023,234 | 5/1977 | Martinec et al. | 15/416 X |
| 4,028,765 | 6/1977 | Liebscher | 15/42 |

*Primary Examiner*—Christopher K. Moore

*Attorney, Agent, or Firm*—Andrus, Sceales, Starke & Sawall

[57] ABSTRACT

A brush assembly is fixedly mounted to each side wall of a vacuum cleaner head closely adjacent the axis of a rotary brush. The brush bristles of each assembly are directed so as to brushingly engage the wall-floor corner. The brushes are aligned in the direction of longitudinal movement of the vacuum cleaner. A guide slot is formed in the head adjacent the end of each brush assembly, with each slot providing communication between the outside of the head and the vacuum chamber containing the rotary brush. Dirt and debris loosened by the brush assemblies is sucked through the channels formed by the slots and the floor, and then into the path of the rotary brush and into the vacuum chamber.

4 Claims, 3 Drawing Figures

VACUUM CLEANING

BACKGROUND AND SUMMARY OF THE INVENTION

This invention relates to vacuum cleaning and more particularly to the cleaning of floor surfaces by means of vacuum.

It is, of course, known to vacuum clean a floor surface by translating a vacuum head in a back and forth reciprocating movement over the floor. It is also known to provide a cylindrical rotating brush in association with the vacuum nozzle or inlet to loosen dirt and debris on the floor and sweep it directly into the path of air flowing into the head.

Such vacuum cleaners are nowdays relatively efficient in cleaning floor surfaces spaced from walls and baseboards. However, a problem has long existed as to how to clean areas closely adjacent the intersection of a wall and the floor. These areas are apt to accumulate large amounts of dirt and debris, and yet they have been found to be very difficult to clean with known vacuum cleaners. Special attachments and tools or a very high powered vacuum have usually been required to get these corners really clean, especially when the material is embedded.

The present invention is directed to a solution to the aforementioned problem.

In accordance with one aspect of the invention, a brush assembly is fixedly mounted to each side wall of the vacuum cleaner head closely adjacent the axis of the rotary brush. The brush bristles of each assembly are directed so as to brushingly engage the wall-floor corner. The brushes are aligned in the direction of longitudinal movement of the vacuum cleaner.

In accordance with another aspect of the invention, a guide slot is formed in the head adjacent the end of each brush assembly, with each slot providing communication between the outside of the head and the vacuum chamber containing the rotary brush. Dirt and debris loosened by the brush assemblies is sucked through the channels formed by the slots and the floor, and then into the said vacuum chamber and into the path of the rotary brush. The need for special corner tools or a very high vacuum is thus substantially eliminated.

BRIEF DESCRIPTION OF THE DRAWINGS

The drawings furnished herewith illustrate the best mode presently contemplated by the inventor for carrying out the invention.

In the drawings.

DESCRIPTION OF THE PREFERRED EMBODIMENT

Figure 1:
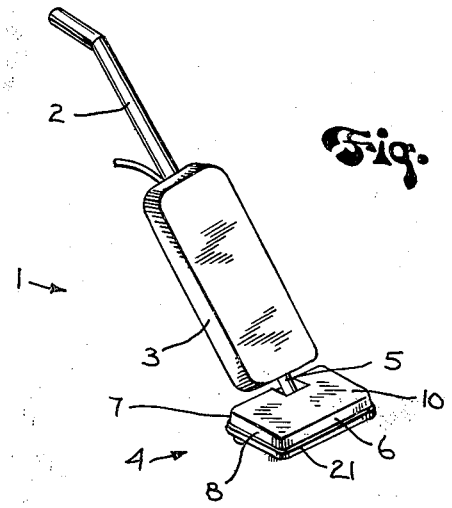
FIG. 1 is a perspective view of a vacuum cleaner which incorporates the concepts of the invention.

The concepts of the invention are adapted to be embodied in a vacuum cleaner 1 which may be of any well-known type but which in this instance comprises an upper unit having a handle 2 and a dirt receiving receptacle 3 thereon. A cleaning head 4 is adapted to be permanently or detachably mounted to the upper unit via a tube 5 which may serve as a suction connection from head 4 into receptable 3.

Head 4 may be of any suitable construction. As shown, the head comprises a housing having front and rear walls 6, 7 joined by side walls 8, 9, and a top cover portion 10. A bottom panel 11 is suitably mounted beneath the housing walls and carries rearwardly disposed support wheels 12 and a motor 13. Motor 13 is connected at one end to a vacuum fan 14, and at the other end through a drive belt 15 to a transversely extending cylindrical rotary brush 16, the ends of which are suitably journalled in or adjacent side walls 8 and 9. Brush 16 is disposed in a chamber 17 defined by front wall 6, a transverse partition 18 spaced rearwardly from wall 6, and forwardly extending partition end walls 19. Chamber 17 forms a vacuum nozzle or inlet which communicates through fan 14 and a passage 20 and tube 5 to receptable 3.

A protective peripheral bumper 21 of rubber or other suitable material is disposed about head 4 and projects outwardly from its side walls.

Figure 3:
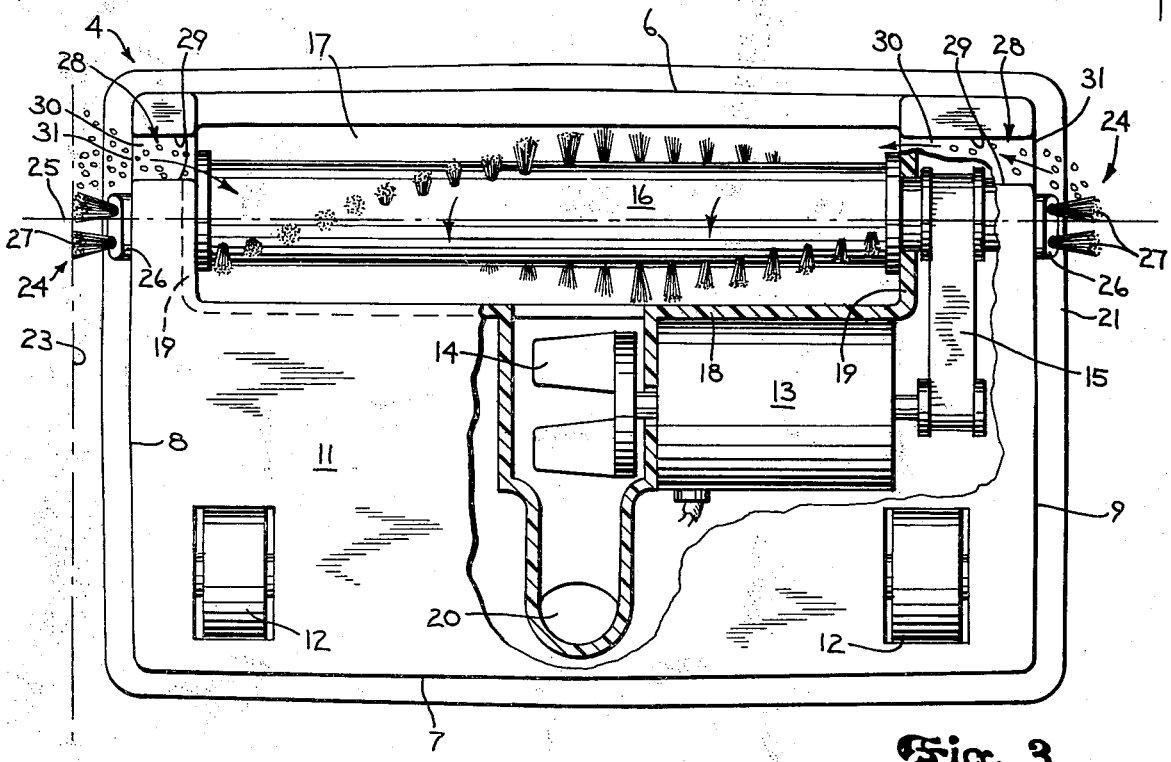
FIG. 3 is a bottom plan view of the head taken on line 3—3 of FIG. 2 and with parts broken away and in section.

The device is adapted to be reciprocably translated over a floor 22, during which time motor 14 rotatably drives brush 16 in the direction shown by the arrows in FIG. 3, that is, rearwardly at the line of brush-floor contact. Brush 16 forms means to loosen dirt and debris from the floor surface so that the suction formed at the nozzle draws the material up into tank 3.

Figure 2:
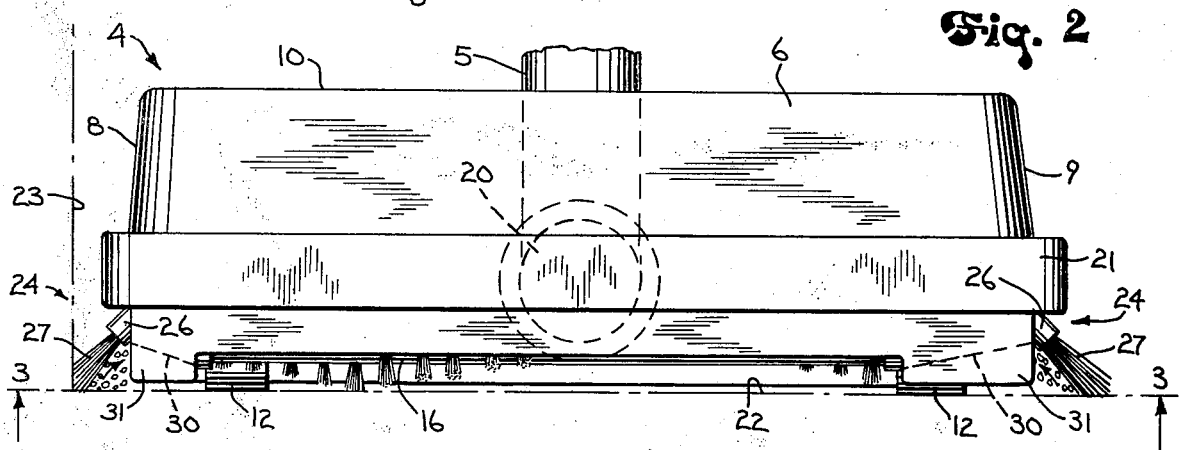
FIG. 2 is an enlarged front view of the vacuum cleaner head disposed on the floor adjacent a room corner.

As hereinbefore mentioned, it has previously been difficult to vacuum clean corners with devices of the above-described type. As shown in FIGS. 2 and 3, such corners comprise the intersection of floor 22 with an upstanding wall 23, the latter comprising the actual wall itself or a baseboard.

In accordance with one aspect of the invention, means are provided on the outside of head 4 to loosen dirt and debris disposed at a corner. For this purpose, a stationary brush assembly 24 is fixedly mounted to the outer face of each side wall 8 and 9 and closely adjacent the axis 25 of rotary brush 16. In the present embodiment, assemblies 24 intersect axis 25.

Each assembly comprises a base member 26 having a plurality of tufted brushes 27 mounted therein, with the separate discrete tufts spaced in a direction to form a brush line extending parallel to the longitudinal direction of translation of the vacuum cleaner. Brushes 27 extend transversely outwardly and downwardly from the housing at an angle of about 45° so that they engage floor 22, and also wall 23 when the device is adjacent a corner. During cleaner translation, brushes 27 loosen dirt and debris from the floor, corner and wall for subsequent pickup by head 4. Because the brushes are longitudinally aligned, they will pass over a given spot in succession, thereby enhancing their ability to loosen stubborn dirt.

In accordance with another aspect of the invention, means are utilized to provide air flow communication from adjacent brushes 27 outside of the head to chamber 17 and rotary brush 16. For this purpose, a pair of transverse slots 28 are disposed in head 4, in this case the slots being formed in bottom panel 11. Each slot is disposed adjacent one of the brush assemblies 24, and as shown in the embodiment of FIG. 3, is positioned just forwardly of its respective assembly. Each slot 28 includes spaced transversely extending edges 29 and a top wall 30, the latter being inclined inwardly and downwardly. The slots extend between the outside and the forward portion of chamber 17 adjacent rotary brush 16.

When the device is in its normal operating position on the floor, slots 28 form, together with floor 22, restricted guide channels 31 for relatively high velocity air flow therethrough. Due to the incline of top walls 30, the mouth of each channel is higher than the inner terminous discharge portion. As the vacuum cleaner moves across the floor, material loosened by brushes 27 is first drawn by the vacuum through the wide slot mouths, which are high enough to pick up material which may have been flicked upwardly by the brushes. The material is then drawn by vacuum through channels 31 into chamber 17 where it is drawn by the air flow into engagement with rotating brush 16 above the floor. Brush 16 assists in propelling the material toward discharge.

The device of the invention provides a unique solution to the problem of vacuuming corners. Manufacturing expense is low, and maintenance costs are at a minimum.

Various modes of carrying out the invention are contemplated as being within the scope of the following claims particularly pointing out and distinctly claiming the subject which is regarded as the invention.

I claim:

1. For use in a vacuum type floor cleaner having means to provide a suction flow of air, a lower head unit comprising:

(a) a housing having front and rear walls joined by side walls, (b) means on said housing forming a vacuum inlet chamber, (c) a transversely extending rotary brush disposed in said chamber, (d) means to drive said rotary brush so that dirt and similar material on the floor are loosened thereby and sucked into said chamber by the flowing air, (e) downwardly inclined stationary brush means fixedly attached on each side of said housing and extending transversely outwardly therefrom for engagement with the floor for loosening said material as said floor cleaner is translated over the floor so that said latter loosened material is sucked into said chamber, (f) and a transverse slot disposed in said housing adjacent each said brush means and communicating between the outside of said housing and said chamber so that material loosened by said brush means is drawn by the air flow through the slot and into said chamber, (g) each said transverse slot being disposed forwardly of its respective brush means and communicates with the forward part of said chamber adjacent said rotary brush so that material drawn through said slot is brought into engagement with said rotary brush.

2. The head unit of claim 1 wherein said brush means are disposed adjacent the ends of said rotary brush and comprise a plurality of stationary brush bristles formed in a line which is parallel to the longitudinal direction of cleaner translation.

3. The head unit of claims 1 or 2 wherein each said slot comprises spaced transversely extending edges and a top wall which, together with the floor, form a restricted guide channel for air flow therethrough.

4. The head unit of claim 3 wherein the said top wall of said slot is inclined downwardly and inwardly toward said rotary brush.

* * * * *